US005330384A

United States Patent [19]

Shapley et al.

[11] Patent Number: 5,330,384

[45] Date of Patent: Jul. 19, 1994

[54] VERTICAL COIN STRIPPER MECHANISM

[75] Inventors: Donald A. Shapley; Roger L. Wilson, both of Conway, Ark.

[73] Assignee: Polyveno Ark., Conway, Ark.

[21] Appl. No.: 968,814

[22] Filed: Oct. 30, 1992

[51] Int. Cl.[5] ..... G07D 1/00

[52] U.S. Cl. ..... 453/17; 453/40; 221/123; 221/265

[58] Field of Search ..... 453/17, 20, 32, 33, 453/40, 49, 57; 221/93, 112, 114, 116, 115, 123, 132, 265

[56] References Cited

U.S. PATENT DOCUMENTS

| | | | |
|---|---|---|---|
| 3,260,337 | 7/1966 | Greenwald et al. | 221/93 X |
| 3,971,393 | 7/1976 | Akai et al. | 453/17 |
| 4,199,669 | 4/1980 | Vogt | 453/17 X |

FOREIGN PATENT DOCUMENTS

| | | | |
|---|---|---|---|
| 3915098 | 11/1990 | Fed. Rep. of Germany | 221/123 |

*Primary Examiner*—F. J. Bartuska
*Attorney, Agent, or Firm*—Stephen D. Carver

[57] ABSTRACT

A coin payout mechanism for vending machines dispenses coins stored in vertical columns. The mechanism comprises an upper frame plate, a plastic retaining plate, a rigid coin receptor plate, a rotatable disk confined within a spacer plate, a bottom escape plate, and a motor-gear assembly to drive the rotatable disk and switches to monitor rotation and coin levels. The plates are fixed together in a stacked relationship; preferably all are square and of similar dimensions. The switches and motor assembly are mounted on the frame plate, which mounts the mechanism within a vending machine. A drive shaft of the motorgear assembly passes through a central orifice defined in the frame and the retaining and receptor plates. The retaining plate receives two coin tubes. The rigid coin receptor plate defines coin receptor orifices coaxial to the tubes. The rotatable disk is generally circular and defines a single oblong stripper orifice near its edge. The stripper orifice alternately indexes with the tubes. The rotatable disk has a hub to receive the shaft of the motor-gear assembly. The spacer plate is of a thickness corresponding to the thickness of the coin(s) to be handled by the mechanism. It defines a circular central area slightly larger then the rotatable disk to captivate the disk between the rigid coin receptor plate and the escape plate. The escape plate defines two coin escape orifices to allow the exit of coins carried from the coin receptor orifices by the stripper orifice.

18 Claims, 4 Drawing Sheets

VERTICAL COIN STRIPPER MECHANISM

BACKGROUND OF THE INVENTION

The present invention broadly relates to coin handling apparatus for vending machines. More particularly, the present invention relates to apparatus for inventorying coins, preferably dollars, and for dispensing them to make change.

In its preferred embodiment the present invention is used to pay out dollar coins as change for purchases made with large denomination bills in vending machines. The art believed to be most pertinent to the present invention is classified in U.S. Class 453, subclasses 9 and 57 as well as various subclasses of U.S. class 21.

Traditionally vending machines have been employed to dispense relatively low cost items such as soft drinks, candy, and newspapers. However, modern marketing practices employ the use of vending machines to dispense higher cost items. As it is inconvenient to use a large number of relatively low denomination coins such as quarters or dimes to purchase items from these machines they often include paper currency validators. However, it is often necessary that change be given as a result of these purchases. Therefore, it is desirous to provide a method to dispense relatively high denomination coins such as dollar coins.

The prior art reveals a large number of coin handling and sorting devices that include rotating "stripper" disks. Many coin handling devices utilize rotating disks of various forms. The disks can be disposed at various angles in several different orientations with respect to hoppers of different shapes and sizes. Several versions of rotating-disk coin handlers exist in this art, and some have coin-captivating recesses defined in them for temporarily admitting and moving a coin.

U.S. Pat. Nos. 5,030,165 and 4,943,257, speak to a coin sorter. They disclose a rotary disc which is mounted beneath a coin supply tube for extracting stacked coins. The thickness of the coin-receptive segment in the rotating disc is essentially that of a coin, so that one coin at a time is admitted. An orifice defined in the bottom plate of the device is designed to receive coins of a diameter smaller than those desired. Those of the proper diameter are discharged by the disc.

Suris U.S. Pat. No. 5,061,222, issued Oct. 29, 1991, discloses a bulk hopper in which coins are disposed in essentially a random manner, and coins are extracted from the hopper radially through a rotating stripper disk disposed beneath the hopper. Coins drop through the funnel shaped hopper toward the coin receiving disk, which is rotatable with a payout wheel.

U.S. Pat. No. 5,000,718 discloses a rotary disk coin dispensing apparatus. A rotary disk, splined to a shaft, actuates coin transporting pins for extracting coins from a hopper. As the apparatus rotates the coins are deflected into proper position for transportation through a chute.

U.S. Pat. No. 4,822,318 discloses a rotary disk system wherein coins are moved by centrifugal force through an exit slot. Shirasawa U.S. Pat. No. 4,810,230 shows another variation of the latter construction. Again a rotating disk is included near the bottom of the hopper, and coins are extracted through centrifugal force.

U.S. Pat. No. 4,798,558 shows a rotary disk which separates coins in an annulus. The coins are deflected radially. U.S. Pat. No. 5,066,262 again discloses a rotating disk arrangement, and captivates coins in an annulus. Coins are twisted and discharged through inclined slots.

U.S. Pat. No. 4,469,245 discloses a bulk dispenser for coin rolls. The coin rolls are conveyed upwardly through a chute. Transverse extraction occurs near the bottom of the apparatus.

Dabrowski patent 4,997,405 discloses a pair of stripper disks having orifices. These disks rotate at different speeds to strip coins from a hopper and dispense them.

Shireman patent 4,398,550 discloses a rotatable coin separating mechanism having upper and lower counter rotating stripper disks with coin captivating orifices. This patent is primarily concerned with reversing mechanisms to clear jams.

Therefore it is desirous to provide a coin dispensing mechanism which can reliably handle large denomination coins such as "Susan B. Anthony" U.S. Dollar Coins without the use of complicated reversing mechanisms to prevent jamming. Such a mechanism must of course be dependable and would certainly need to be vandal proof. It is particularly important in such circumstances that the mechanism be sealed securely, as it will contain a relatively large amount of money.

SUMMARY OF THE INVENTION

The present invention is a coin dispensing mechanism which can reliably handle large denomination coins. The highly dependable design incorporates only one moving part. Furthermore, it is resistant to theft of coins by providing a solid plate as a base to thwart the use of jimmies or wires. The preferred embodiment of the present invention is used to make change in vending machines employing a validator to accept bills of varying denominations. Therefore, the present invention dispenses coins of relatively large denominations such as Susan B. Anthony one dollar coins.

The preferred embodiment of the present invention is principally comprised of a top frame plate assembly, a rotatable disk and a bottom escape plate. The rotatable disk is driven by a stepper motor and gear assembly. A microswitch assembly associated with the motor and gear assembly monitors the degree of rotation imparted to the rotatable disk and provides feedback to an electronic control system for the entire machine. Limit switches are employed to monitor the level of coins retained in the coin tubes.

Specifically the top plate assembly is comprised of an upper frame plate, a plastic retaining plate, and a rigid coin receptor plate. The upper frame plate is constructed of galvanized or other rust proof sheet metal and is of a generally square shape. The limit switches are mounted on the frame plate and the frame plate is employed to mount the mechanism within a vending machine. The motor and gear assembly are mounted to the dorsal surface of the frame plate. The drive shaft of the motor and gear assembly passes through a central orifice common to all the plates of the top plate assembly to index the rotatable disk.

The retaining plate is constructed of relatively thick plastic. It is preferably square, being of dimensions approximating those of the upper frame plate. The retaining plate defines two tube receptive orifices to receive the coin tubes which are glued into place. Vertical slits are disposed along the sides of the coin tubes. The limit switches are indexed with the slits in order to sense the level of coins in the tube.

The rigid coin receptor plate defines coin receptor orifices coaxial to the tube receptive orifices of the plastic retaining plate. The rigid coin receptor plate provides a bearing surface for the coin tubes.

The rotatable disk is generally constructed of galvanized or other noncorroding metal such as stainless steel. It is generally circular and defines a single oblong orifice near its edge. The oblong orifice alternately indexes with the aforementioned coin receptor orifices in the rigid coin receptor plate. The rotatable disk has a central hub with a rectangular boss that receives the shaft from the motor and gear assembly.

The rotatable disk is retained within the mechanism by a spacer plate. The spacer plate is square and of dimensions similar to the top plate assembly and the escape plate. Its thickness corresponds to the thickness of the coin or coins to be handled by the mechanism. The spacer plate defines a circular central area which has a diameter slightly larger then the rotatable disk.

The top plate assembly and the spacer plate are screwed to the escape plate through holes in the corner of each. The rotatable disk is captivated within the circular central area of the spacer plate, between the rigid coin receptor plate and the escape plate. The escape plate is square with generally the same dimensions as the coin receptor and spacer plates. The escape plate defines two coin escape orifices.

The motor and gear assembly is comprised of an electric motor and a gear assembly within a housing. The gear assembly provides a mechanical advantage for rotation of the rotatable disk. The upper portion of the gear assembly's shaft protrudes from the housing. The shaft provides a camming surface to activate the microswitch.

A wiring harness provides power to the system and provides input from the limit switches and the microswitch to the electronic control system. The control system is primarily a preprogrammed electronic control system which dictates the amount to be paid out by the mechanism. Control is maintained by dictating the number of revolutions of the rotatable disk will turn for a particular payout.

Therefore, a primary object of the present invention is to provide a dispensing mechanism which will strip off and vend one stackable item at a time.

A related object of the present invention is to provide a vertical stripper mechanism for a coin payout assembly which will strip off and vend one coin at a time.

A more specific, related object of the present invention is to provide a coin stripper mechanism which can strip off and vend one U.S. dollar coin at a time, namely a "Susan B. Anthony" Dollar Coin.

Another object of the present invention is to provide a coin stripper mechanism which is invulnerable to the use of wires or jimmies to remove product or coins.

A related object of the present invention it to provide a coin stripper mechanism which is resistant to being disturbed by shaking or bouncing the cabinet of the vending machine in which it is contained.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
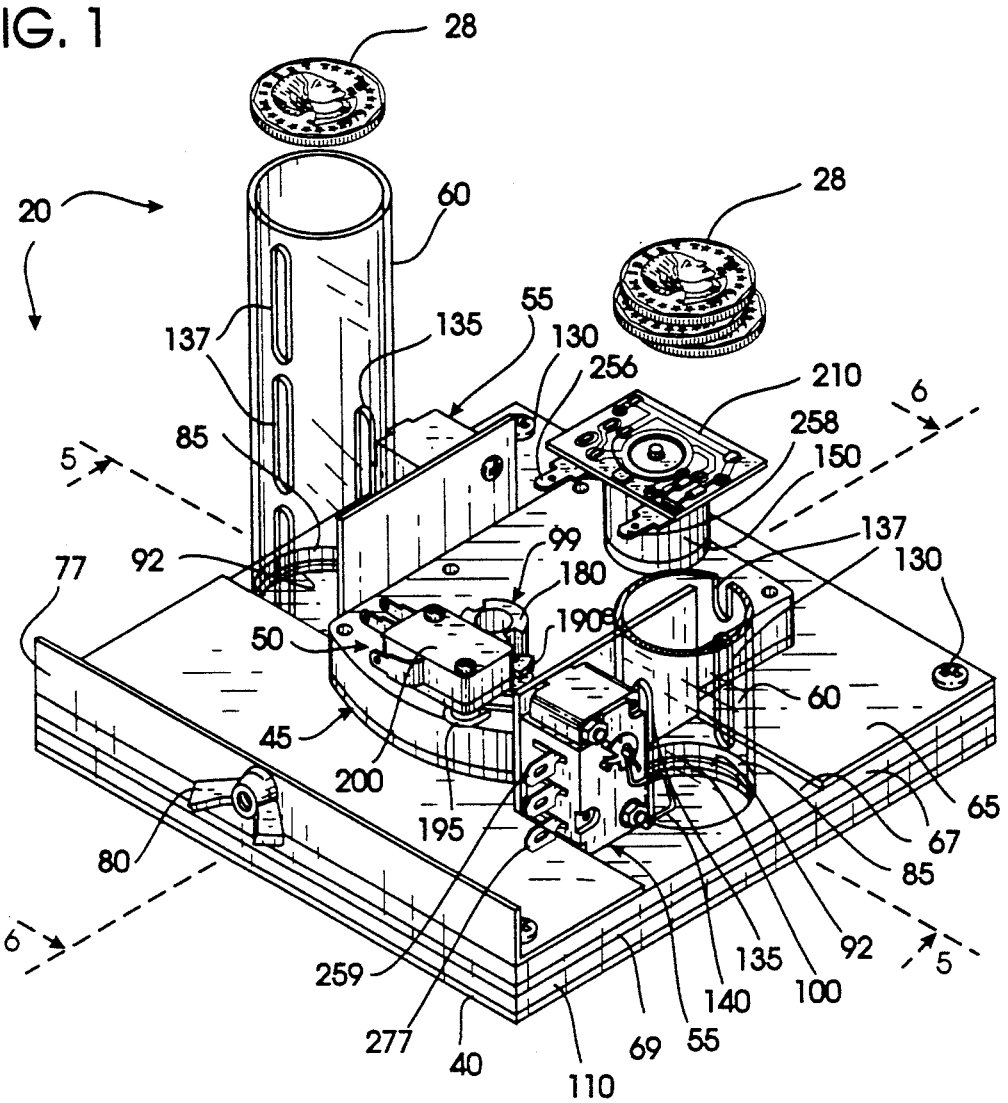
FIG. 1 is a partially exploded, fragmentary isometric view of the preferred embodiment of the present invention.

With reference now to the accompanying drawings, the present coin stripper and payout mechanism is broadly designated by the reference numeral 20. The preferred embodiment is used in a vending machine intended to dispense relatively high cost articles. The machine is adapted to receive bills of varying denominations via a validator. In its preferred embodiment the present invention dispenses coins 28 of a relatively large denomination, such as one dollar coins.

Figure 4:
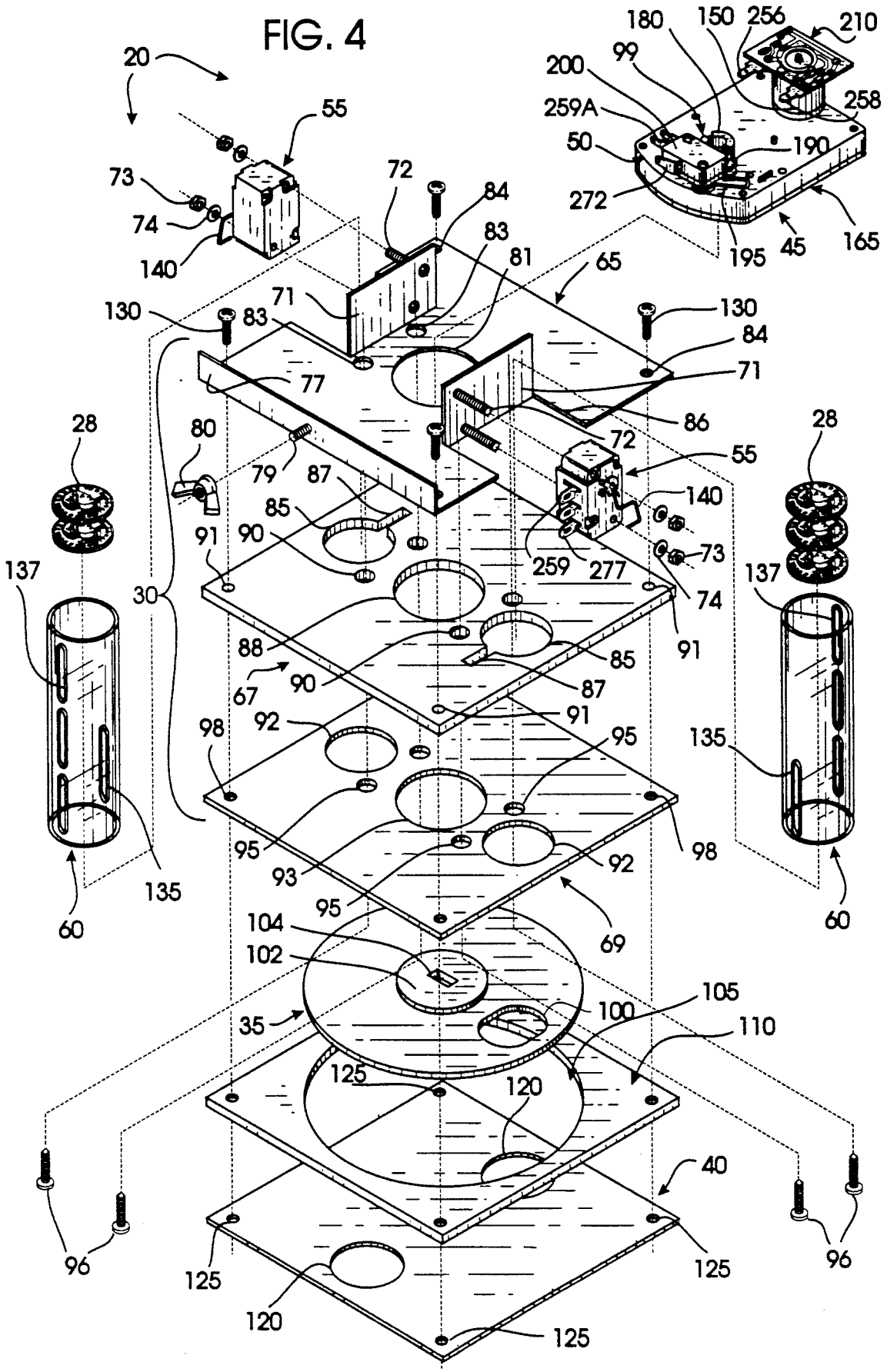
FIG. 4 is an exploded isometric view of the preferred embodiment of the present invention.
Figure 5:
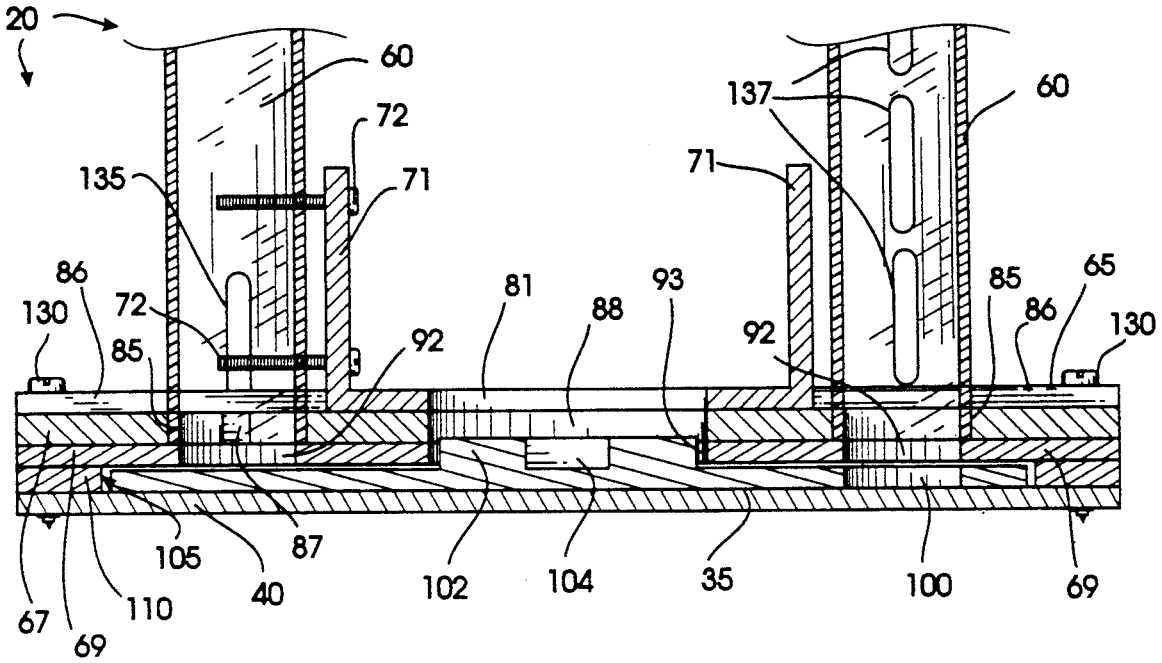
FIG. 5 is a cross section of the preferred embodiment of the present invention taken along line 5—5 of FIG. 1, with portions omitted for clarity.
Figure 6:
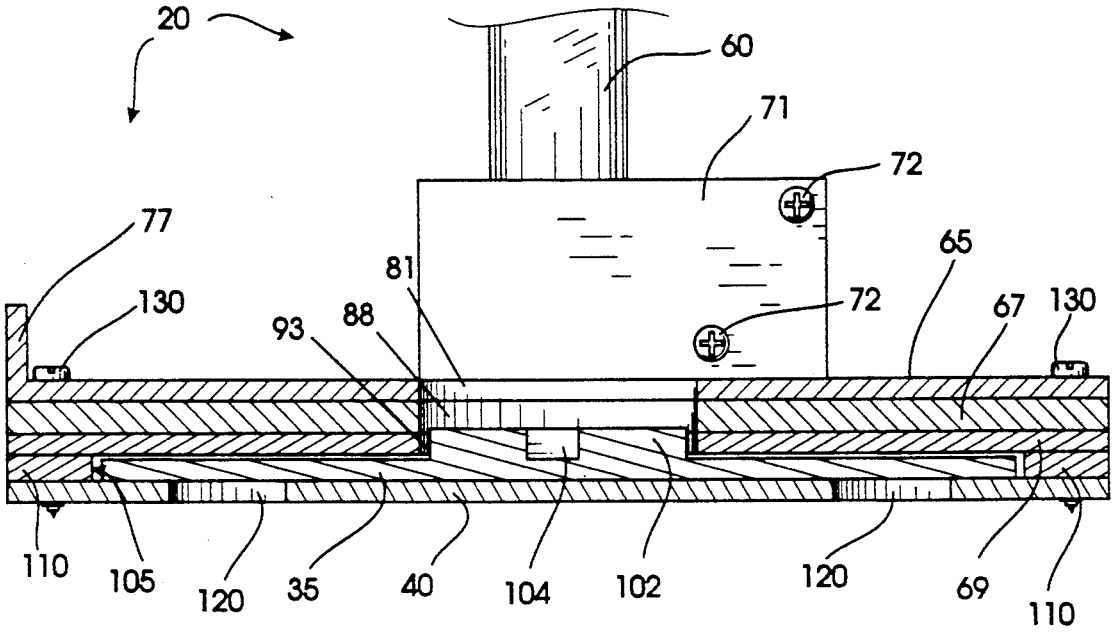
FIG. 6 is a cross section of the preferred embodiment of the present invention taken along line 6—6 of FIG. 1, at a right angle to the cross section of FIG. 5, with portions omitted for clarity.

The interrelationship of the various elements of the preferred embodiment of the present invention is best illustrated in FIG. 4. Mechanism 20 is principally comprised of a top plate assembly 30, a rotatable disk 35, and a bottom escape plate 40. The rotatable disk 35 is driven by a motor and gear assembly 45. A cam and microswitch assembly 50 associated with the motor and gear assembly 45 monitors the degree of rotation imparted to the rotatable disk 35. Limit switches 55 are employed to monitor the level of coins 28 retained in the coin tubes 60.

The top plate assembly 30 is comprised of a rigid frame plate 65, a plastic retaining plate 67, and a rigid coin receptor plate 69. The rigid frame plate 65 is constructed of painted, galvanized or noncorroding sheet metal and is of a generally square shape. Two vertical flanges 71 bent from the plate material extend upward. The flanges each mount two studs or screws 72. The limit switches 55 are mounted on the studs 72 employing nuts 73 and washers 74. The frame plate 65 further defines an upwardly projecting lip 77. A mounting stud 79 extends from the lip 77. This stud 79 and a wing nut 80 are employed to mount the mechanism 20 within a vending machine. Further, the frame plate 65 defines a central drive orifice 81 and four peripheral screw orifices 83. A screw receptive hole 84 is defined in each corner of the frame plate 65.

The retaining plate 67 is constructed of relatively thick plastic. It is preferably square, approximating the dimensions of the frame plate 65. The retaining plate 67 defines two tube receptive orifices 85 corresponding to the notches 86 created by the upwardly extending flanges 71 of the frame plate 65. The tube receptive orifices 85 receive the coin tubes 60. The tubes 60 are glued in place within the orifices 85. A relief slot 87 extends radially from each tube receptive orifice 85. The retaining plate 67 further defines a central drive orifice 88 corresponding to the central drive orifice 81 of the frame plate 65. Also, four relief orifices 90 in the retaining plate 67 correspond to the screw orifices 83 of the frame plate 65. A screw receptive hole 91 is defined in each corner of the retaining plate 67.

The rigid coin receptor plate 69 defines coin receptor orifices 92 coaxial to the tube receptive orifices 85 of the plastic retaining plate 67. The coin receptor orifices 92 have a diameter generally equal to the internal diameter of the coin tubes 60. Therefore, the rigid coin receptor plate 69 provides a bearing surface for the coin tubes 60. Further, a central drive orifices 93 defined in the rigid coin receptor plate 69 corresponds to the two aforementioned central drive orifices 81 and 88. Relief orifices 95 also index with the aforementioned relief orifices 90 and 83. A screw receptive hole 98 is defined in each corner of the coin receptor plate 69.

The motor and gear assembly 45 is secured to the frame plate 65 by screws 96. The screws pass through the screw orifices 83. The heads of the screws occupy the screw relief orifices 90 and 95. The motor and gear assembly is indexed over the drive orifices 81, 88, and 93. A drive shaft 99 extends downwardly from the motor and gear assembly 45 to index the rotatable disk 35.

The rotatable disk 35 is generally constructed of galvanized or other noncorroding metal such as stainless steel. It is generally circular and defines a single oblong coin stripper orifice 100 near its edge. The stripper orifice 100 alternately indexes with the aforementioned coin receptor orifices 92 in the rigid coin receptor plate 69. The rotatable disk 35 further defines a central drive hub 102 which in turn defines a rectangular boss 104. The rectangular boss 104 is intended to received the drive shaft 99 depending downwardly from the motor and gear assembly 45 through the central drive orifices 81, 88 and 93 of the top plate assembly 30.

The rotatable disk 35 is retained within the mechanism 20 by a spacer plate 110. The spacer plate 110 is square and of dimensions similar to the top plate assembly 30 and the bottom escape plate 40. The spacer plate 110 defines a circular central area 105 which has a diameter slightly larger then the rotatable disk 35. A screw receptive hole 115 is defined in each corner of the spacer plate 110.

The top plate assembly 30 and the spacer plate 110 are secured to the escape plate 40. The rotatable disk 35 is captivated between the top plate assembly 30 and the escape plate 40 within the spacer plate 110. The escape pate is square with dimensions similar of the aforementioned square components 65, 67 and 69 and the spacer plate 110. The escape plate 40 defines two coin escape orifices 120. The 'above described coin receptive orifices 92 are disposed ninety degrees from the escape orifices 120, along the arc described by the stripper orifice 100. Stated another way, an imaginary line passing through the centers of the coin receptive orifices 92 would be perpendicular to an imaginary line passing through the centers of the escape orifices 120. Screw receptive holes 125 are defined in the corners of the escape plate 40. A sheet metal screw 130 passes through each set of aligned screw receptive holes 84, 91, 98, 115 and 125 to retain the components in a stacked relationship.

As mentioned above the coin tubes 60 are disposed within the tube receptive orifices 85 of the plastic retaining plate 67. Generally, the coin tubes 60 are glued in place. Alternatively, the coin tubes 60 may be cast, along with the plastic retaining plate 67, as a single unit. A vertical sensor slit 135 is disposed along one side of each of the coin tubes 60. A set of elongated ventilation slits 137 are defined in the opposite side of the coin tubes 60. The limit switches 55 mounted to the upwardly extending flanges 71 of the frame plate 65 employ sensor arms 140 for activation. The sensor arms 140 are indexed with the vertical sensor slits 135 of the coin tubes and relief slots 87 in the plastic retaining plate 67. Once the coin level falls below the level of the arm 140 in either tube 60 the switch 55 is activated. This results in a coin out condition or exact change condition in the vending machine.

As mentioned before the motor and gear assembly 45 is mounted to the top plate assembly 30 by screws 96. The motor and gear assembly 45 is comprised of an electric motor 150 and a gear assembly housed within a housing 165. The gear assembly provides a mechanical advantage for rotation of the rotatable disk 35. The drive shaft 99 extends upwardly from the housing 165 as well as downwardly. The upper portion of the shaft 99 provides a camming surface 180 and the downwardly extending portion indexes with the boss 104 in the hub 102 of the rotatable disk 35. The cam surface 180 of the shaft 99 drives a follower 190 which is spring biased by a spring 195 to maintain contact with the cam surface 180 of the shaft 99. The follower 190 activates the button 205 of a microswitch 200 thereby monitoring the degree of rotation of the drive shaft 99.

Figure 7:
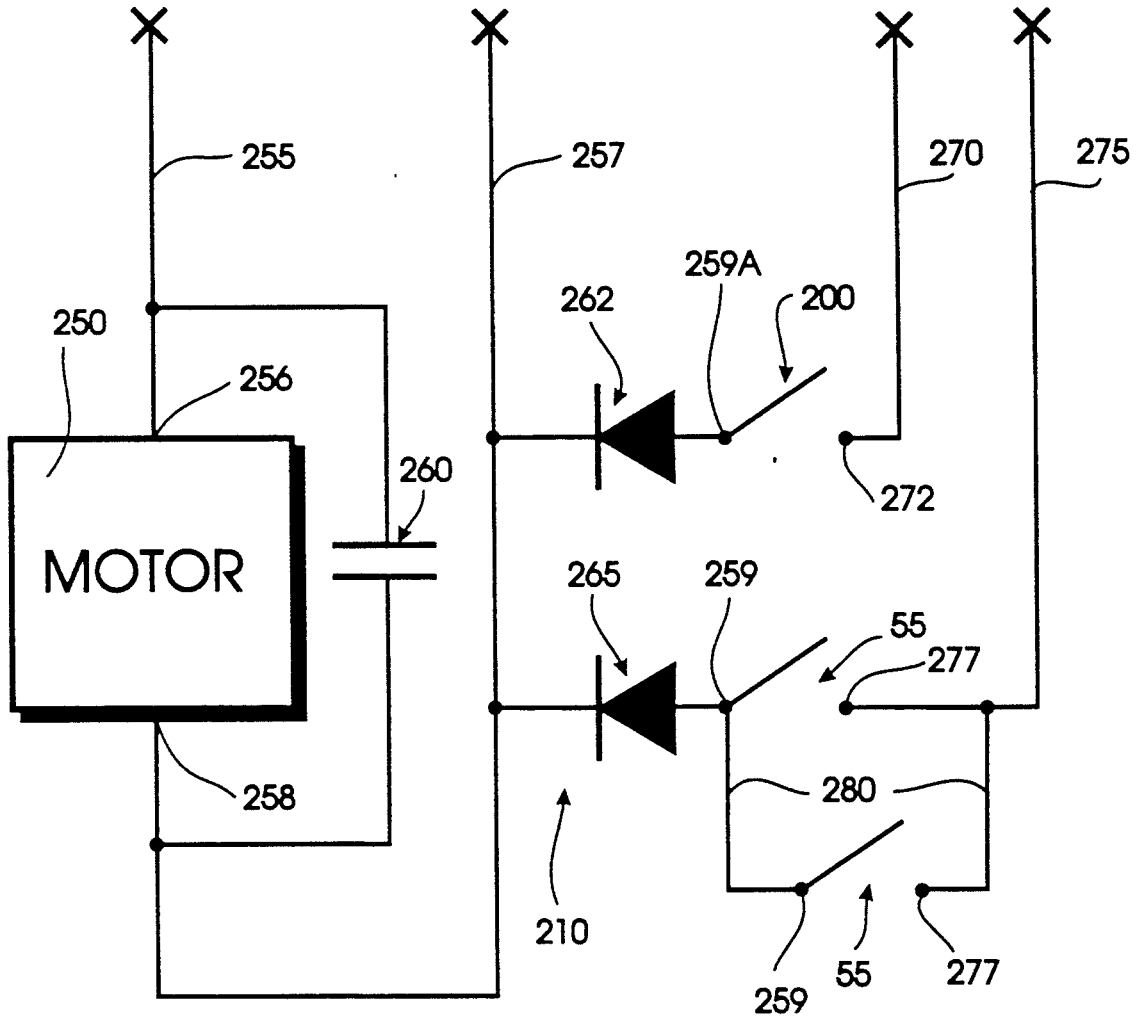
FIG. 7 is an electrical schematic of the wiring harness and circuitry associated with the present invention.

A wiring harness and associated circuit 210 is illustrated in schematic form in FIG. 7. The wiring harness provides power, twenty-four volts direct current, to the motor via wire 255 and transmits feedback from various components of the payout mechanism. The power wire 255 is connected to a spade connector 256. The assembly is grounded via wire 257 connected to a second spade connector 258. The motor 150 employs a capacitor 260. Diodes 262 and 265 rectify and isolate the grounding of the switches 55 and 200. The ground for the limit switches is connected at spade connectors 259 at each switch. The ground for the microswitch is connected at microswitch spade connector 259A.

Figure 2:
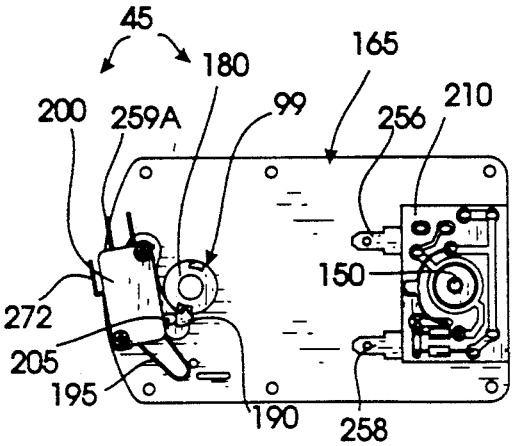
FIG. 2 is a top plan view of the preferred motor and gear assembly of the present invention, illustrating the relationship of the microswitch and the cam surface of the drive shaft.
Figure 3:
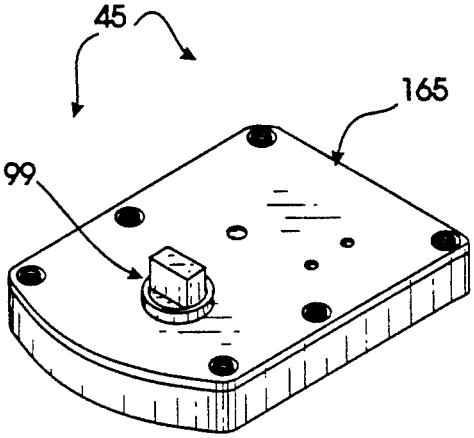
FIG. 3 is an isometric view of the bottom of the motor and gear assembly of the present invention, illustrating the shape of the lower portion of the drive shaft.

In operation, a preprogrammed electronic control system dictates the amount to be paid out by the mechanism 20 by revolving the rotatable disk 35 the necessary number of half revolutions. Each half revolution pays out a single coin 28. The microswitch 200 is activated each time the drive shaft 99 is rotated by the motor and gear assembly 45. The camming surface 180 of the drive shaft 99 depresses the follower 190 to activate the button 205 of the microswitch 200. When the camming surface 180 is no longer depressing the follower 190 (FIG. 2), the microswitch 200 is released. This indicates completion of one-half revolution and payout of one coin 28 which is transmitted to the electronic control system. Feedback from the microswitch 200 is provided to the controlling system by wire 270 connected to microswitch spade connector 272. Feedback from the coin limit switch 55 is transmitted to the controlling system via wire 275, connected to limit switch spade connectors 277. The limit switches are connected to one anther in parallel by wires 280 extending between spade connectors 259. Therefore, if either tube runs out of coins the feedback to the controlling system is a coin out condition.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A coin payout mechanism comprising:

a rigid frame plate adapted to be secured to a supporting structure;

a pair of upwardly projecting coin tubes;

a retaining plate disposed beneath said frame plate for mounting said coin tubes, said retaining plate comprising a plurality of tube receptive orifices in which said coin tubes are disposed;

a stationary coin receptor plate disposed beneath said retaining plate, said receptor plate comprising a pair of coin receptor orifices adapted to be registered with said tube receptive orifices and a central drive orifice disposed between said coin receptive orifices;

a rotatable disk disposed beneath said stationary coin receptor plate, said disk comprising a drive hub registered with said central drive orifice and a spaced apart coin stripper orifice for removing coins entering same when said coin stripper orifice is aligned with one of said coin receptor orifices; and, an escape plate comprising a pair of escape orifices adapted to register with said coin stripper orifice.

2. The coin payout mechanism as defined in claim 1 further comprising a spacer plate defining a circular orifice, said spacer plate surrounding said rotatable disk.

3. The coin payout mechanism as defined in claim 2 wherein said spacer plate is generally of a thickness slightly greater than the thickness of a single coin to be handled by the mechanism.

4. The coin payout mechanism as defined in claim 3 wherein said coin receptor orifices are disposed ninety degrees from the escape orifices, along the arc described by the stripper orifice.

5. The coin payout mechanism as defined in claim 4 further comprising:

vertical sensor slits defined in said coin tubes;

and limit switch means for monitoring said coin tubes for the presence of coins, said limit switch means comprising sensor arms extending into said sensor slits.

6. The coin payout mechanism as defined in claim 5 further comprising drive means for rotating said rotatable disk.

7. The coin payout mechanism as defined in claim 6 wherein said frame plate comprises a central orifice, two upwardly protecting flanges and notches adjacent each of said flanges, said coin tubes projecting upwardly and clearing said frame plate through said notches.

8. The coin payout mechanism as defined in claim 7 wherein said limit switch means is mounted to said flanges.

9. The coin payout mechanism as defined in claim 8 wherein said drive means is mounted on said frame plate, said drive means extending through said central orifice in said frame plate and through said drive orifice in said coin receptor plate, engaging said drive hub of said rotatable disk.

10. The coin payout mechanism as defined in claim 2 wherein said spacer plate is generally of a thickness slightly greater than the thickness of an integer multiplier of the coins to be handled by the mechanism.

11. A coin payout mechanism comprising:

coin tube means comprising:

a rigid frame plate adapted to be secured to a supporting structure, said frame plate comprising a central orifice, two upwardly protecting flanges and two notches, each notch perpendicular to one of said flanges, a pair of coin tubes, projecting upwardly through said notches, said coin tubes defining vertical sensor slits;

a retaining plate for mounting said coin tubes, said retaining plate comprising two tube receptive orifices;

sensing means for monitoring the level of coins in said tubes;

stationary coin receptive means for receiving said coins, said coin receptive means disposed beneath said coin tube means;

rotating disk means for conveying one of said coins in an arc, said rotating disk means disposed beneath said stationary coin receptive means; and, escape means for releasing said coins from said mechanism, said coins being released upon alignment of said escape means and said rotating disk means.

12. The coin payout mechanism as defined in claim 11 wherein said stationary coin receptive means comprises a stationary coin receptor plate disposed beneath said retaining plate, said receptor plate comprising a pair of coin receptor orifices registered with said tube receptive orifices and a central drive orifice disposed between said coin receptive orifices.

13. The coin payout mechanism as defined in claim 11 wherein said rotating disk means comprises:

a rotatable disk disposed beneath said stationary coin receptor plate said disk comprising a drive hub registered with said central drive orifice and a spaced apart oblong coin stripper orifice for removing coins entering same when aligned with one of said coin receptor orifices; and, a spacer plate defining a circular orifice, said spacer plate surrounding said rotatable disk, said spacer plate being generally of a thickness slightly greater than the thickness of a single coin or whole multiples of the coins to be handled by the mechanism.

14. The coin payout mechanism as defined in claim 13 wherein said escape means comprises an escape plate comprising a pair of escape orifices adapted to register with said coin stripper orifice.

15. The coin payout mechanism as defined in claim 14 wherein said coin receptor orifices are disposed ninety degrees from the escape orifices, along the arc described by the stripper orifice.

16. The coin payout mechanism as defined in claim 15 further comprising limit switch means mounted to said flanges for monitoring said coin tubes for the presence of coins, said limit switch means further comprising sensor arms extending into said sensor slits in said coin tubes.

17. The coin payout mechanism as defined in claim 16 further comprising drive means for rotating said rotatable disk, said drive means mounted on said frame plate and extending through said central orifice in said frame plate and through said drive orifice in said coin receptor plate, engaging said drive hub of said rotatable disk.

18. A rotary coin payout mechanism comprising:

rigid frame plate means for securing said mechanism to a supporting structure;

coin tube means for aligning a plurality of coins to be gravitationally dispensed;

retaining plate means affixed to said frame plate means for mounting said coin tube means, said retaining plate means comprising tube receptive orifice means for receiving said coin tube means;

stationary coin receptor plate means for periodically receiving coins, said receptor plate means comprising coin receptor orifice means axially registered with said tube receptive orifice means and a central drive orifice disposed between said coin receptive orifice means;

rotatable disk means for transferring coins from said coin receptor plate means, said disk means comprising a drive hub coaxial with said tube receptive orifice and a spaced apart coin stripper orifice for removing coins when axially aligned with said coin receptor orifice means and radially displacing them; and, an escape plate comprising escape orifice means for axially registering with said coin stripper orifice to dispense a coin when said disk means is rotated.

* * * * *